US012593918B2

(12) United States Patent
Lv et al.

(10) Patent No.: US 12,593,918 B2
(45) Date of Patent: Apr. 7, 2026

(54) CROSS-ELASTIC DIRECTOR'S CHAIR

(71) Applicant: AnHui HanTang Leisure Products Co.,LTD, Suzhou (CN)

(72) Inventors: Liang Lv, Suzhou (CN); Jining Yang, Suzhou (CN)

( * ) Notice: Subject to any disclaimer, the term of this patent is extended or adjusted under 35 U.S.C. 154(b) by 156 days.

(21) Appl. No.: 18/527,796

(22) Filed: Dec. 4, 2023

(65) Prior Publication Data

US 2025/0176723 A1 Jun. 5, 2025

(51) Int. Cl.
*A47C 4/28* (2006.01)

(52) U.S. Cl.
CPC ..... *A47C 4/283* (2013.01)

(58) Field of Classification Search
CPC ..... A47C 4/283
See application file for complete search history.

(56) References Cited

U.S. PATENT DOCUMENTS

| | | | | |
|---|---|---|---|---|
| 9,060,611 | B2 * | 6/2015 | Grace | A47C 4/283 |
| 11,122,903 | B2 * | 9/2021 | Sun | A47C 4/283 |
| 11,172,762 | B2 * | 11/2021 | Zhu | A47C 4/283 |
| 2020/0390242 | A1 * | 12/2020 | Chen | A47C 4/283 |

* cited by examiner

*Primary Examiner* — Anthony D Barfield

(57) ABSTRACT

The present invention discloses a cross-elastic director's chair falling within the area of director's chair, which comprises frame and elastic base feet. The elastic base feet comprise two sets of crossbar 1, crossbar 2, cross frame, and elastic support. The cross frame is movably arranged between crossbar 1 and crossbar 2. By incorporating crossbar 1, crossbar 2, cross frame, and elastic support, the present invention enables the support of the frame during use through the coordination of the cross frame and elastic support with crossbar 1 and crossbar 2. When a user is seated in the frame, the cross frame and the elastic support allow for a slight rocking motion of the frame, enhancing comfort while seated.

6 Claims, 6 Drawing Sheets

CROSS-ELASTIC DIRECTOR'S CHAIR

TECHNICAL FIELD

The present invention relates to a director's chair, particularly a cross-elastic director's chair, which falls within the technical realm of director's chair.

BACKGROUND ART

Director's chair is a collapsible chair that is commonly referred to as a director's chair because of its regular utilization in film production sets. The primary components of a director's chair are frame and surface, and its foldability and portability make it a popular choice for outdoor sports and outdoor operations. Existing director's chairs are designed with fixed base feet, which restrict any rocking movement, thus leading to overall poor comfort. This invention presents a novel solution to tackle the aforementioned problems.

SUMMARY

The present invention aims to overcome the deficiencies of existing art by introducing a new cross-elastic director's chair.

The objective of this invention can be accomplished by implementing the following technical solutions:

A cross-elastic director's chair comprising frame and elastic base feet; said elastic base feet comprise two sets of crossbar 1, crossbar 2, cross frame and elastic support arranged at the bottom of said frame. Said cross frame is movably installed between said crossbar 1 and said crossbar 2.

Preferably, said cross frame comprises a main connecting rod rotatably installed between said crossbar 1 and said crossbar 2.

Preferably, said main connecting rod is flanked by secondary connecting rod 1 and secondary connecting rod 2, which are pivotally mounted on said frame and said crossbar 1, respectively.

Preferably, said crossbar 1 comprises bar 1. The bottom of said bar 1 is fitted with mount 1 accommodating said main connecting rod. The interior of said mount 1 is furnished with mounting shaft 1 used to connect said main connecting rod.

Preferably, said crossbar 2 comprises bar 2. The top of said bar 2 is fitted with mount 2 accommodating said secondary connecting rod 1. The interior of said mount 2 is furnished with mounting shaft 3 used to connect said main connecting rod.

Preferably, said main connecting rod is provided with through-hole 1 that matches with said mounting shaft 1 and said mounting shaft 3.

Preferably, one side of said mount 1 is provided with mounting shaft 2 installed through bar 1, and that one side of said mount 2 is furnished with mounting shaft 4 installed through said bar 2.

Preferably, said secondary connecting rod 1 and said secondary connecting rod 2 are provided with through-hole 2 matching with said mounting shaft 2 and said mounting shaft 4.

Preferably, said elastic support is spring arranged between said crossbar 1 and said crossbar 2, and that the bottom end of said spring is securely attached to the top of said crossbar 2.

Preferably, said elastic support is curved elastic tube; one end of said elastic tube is connected to crossbar 3 while the other end of said elastic tube is connected to said frame.

Beneficial technological effect of the prevent invention: By incorporating crossbar 1, crossbar 2, cross frame, and elastic support, the cross-elastic director's chair of the present invention enables the support of the frame during use through the coordination of the cross frame and elastic support with crossbar 1 and crossbar 2. When a user is seated in the frame, the cross frame and the elastic support allow for a slight rocking motion of the frame, enhancing comfort while seated.

Legend: 1. Frame; 2. First Crossbar; 3. Second Crossbar; 4. Cross frame; 5. Spring; 6. Elastic tube; 7. First through-hole; 8. Second through-hole; 201. First Bar; 202. First Mount; 203. First Mounting shaft; 204. Second Mounting Shaft; 301. Second Bar; 302. Second Mount; 303. Third Mounting shaft; 304. Fourth Mounting shaft; 401. Main connecting rod; 402. First Secondary connecting rod; 403. Second Secondary connecting rod; 501. Connecting sleeve; 502. Fixing tab; 503. Elastic tab.

DETAILED DESCRIPTION

To enhance the clarity and specificity of the technical solution of the present invention for those skilled in the art, the following detailed description is given in conjunction with the embodiments and accompanying drawings. However, it should be understood that the embodiments of the present invention are not limited thereto.

Figure 1:
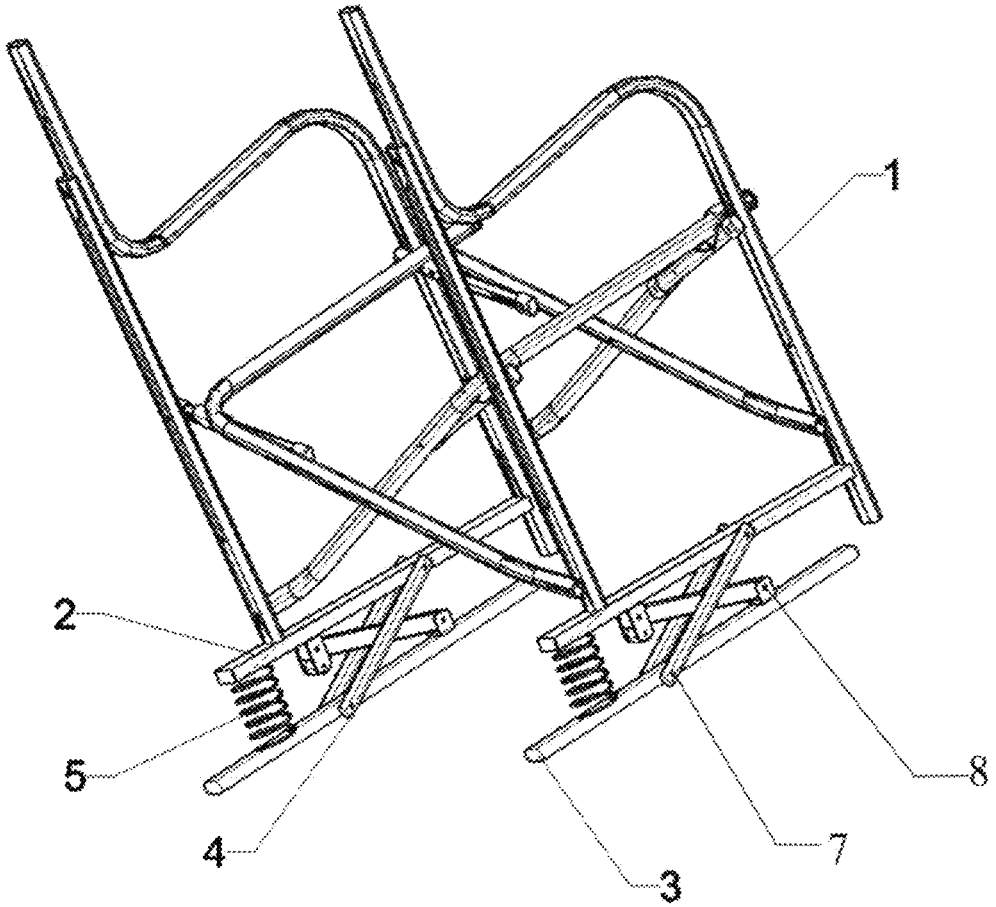
FIG. 1 illustrates the overall structural diagram of a preferred embodiment of the cross-elastic director's chair according to the present invention.
Figure 2:
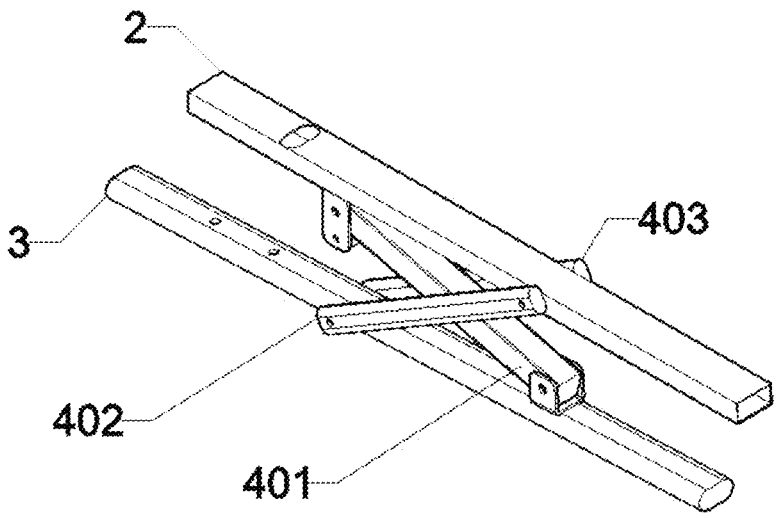
FIG. 2 illustrates the structural diagram of the main connecting rod of a preferred embodiment of the cross-elastic director's chair according to the present invention.
Figure 3:
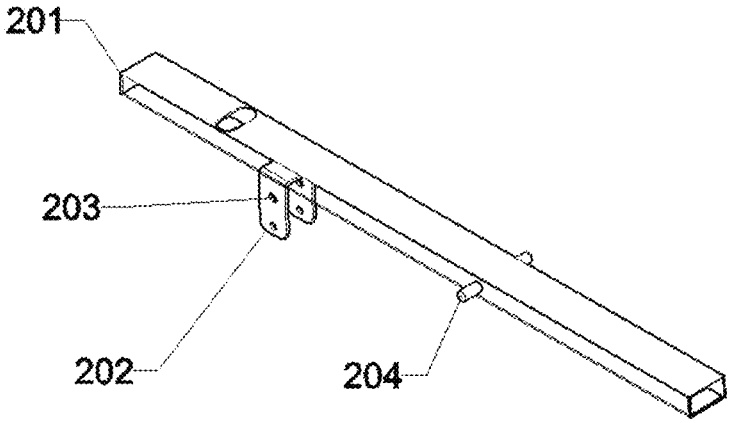
FIG. 3 illustrates the structural diagram of bar 1 of a preferred embodiment of the cross-elastic director's chair according to the present invention.
Figure 4:
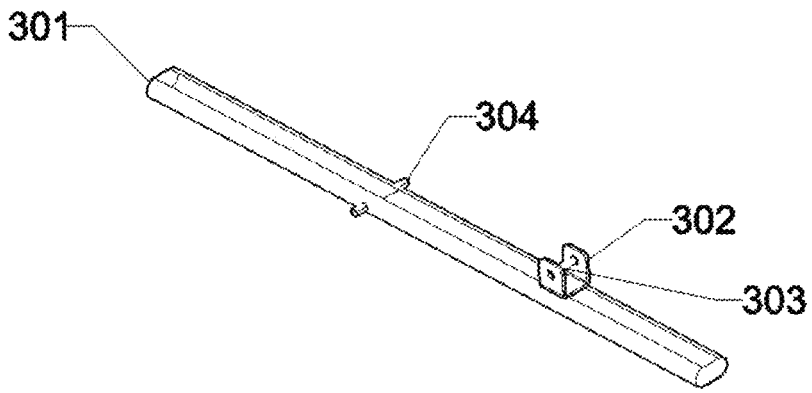
FIG. 4 illustrates the structural diagram of bar 2 of a preferred embodiment of the cross-elastic director's chair according to the present invention.
Figure 5:
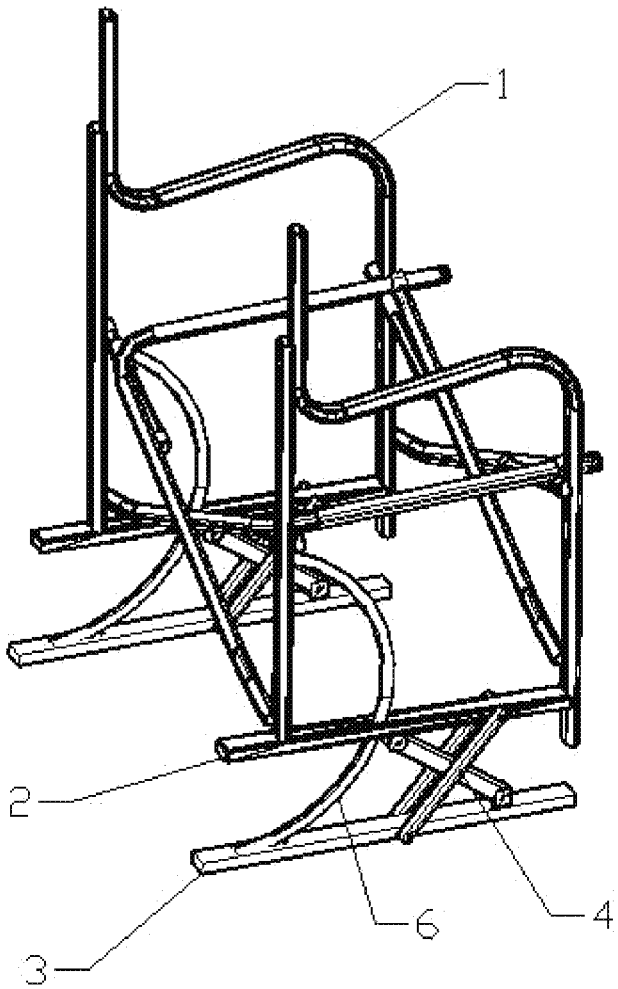
FIG. 5 illustrates the overall structural diagram of a preferred embodiment of the cross-elastic director's chair according to the present invention.
Figure 6:
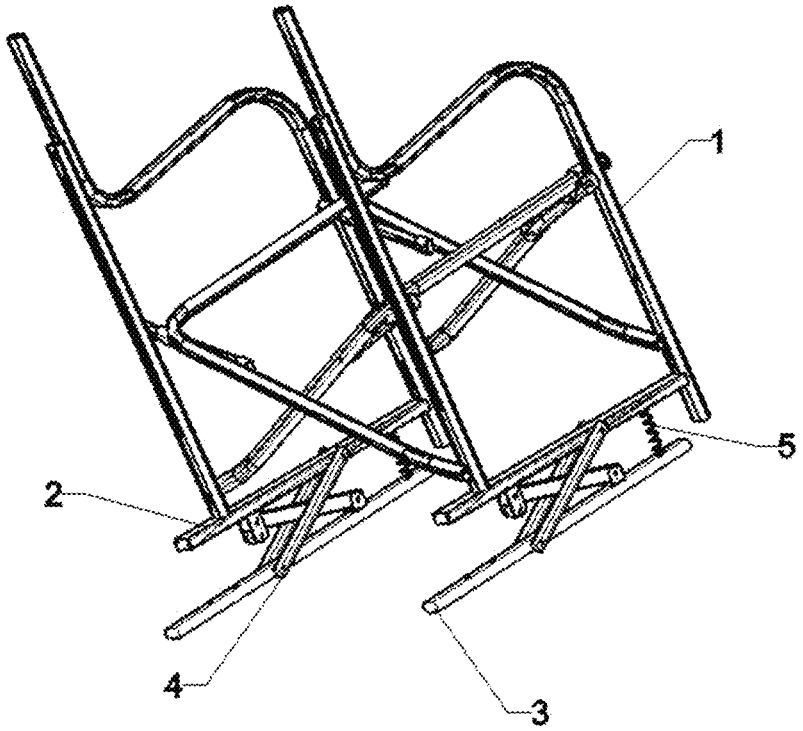
FIG. 6 illustrates the overall structural diagram of a preferred embodiment of the cross-elastic director's chair according to the present invention.

As illustrated in FIGS. 1-6, a cross-elastic director's chair comprises frame 1 and elastic base feet. The elastic base feet comprise two sets of crossbar 1 2, crossbar 2 3, cross frame 4 and elastic support arranged at the bottom of frame 1. Cross frame 4 is movably installed between crossbar 1 2 and said crossbar 2 3. By incorporating crossbar 1 2, crossbar 2 3, cross frame 4, and elastic support 5, the present invention enables the support of frame 1 during use through the coordination of the cross frame 4 and elastic support 5 with crossbar 1 2 and crossbar 2 3. When a user is seated in the frame 1, the cross frame 4 and the elastic support allow for a slight rocking motion of frame 1, enhancing comfort while seated.

Cross frame 4 comprises main connecting rod 401 that is rotatably mounted between cross bar 1 2 and cross bar 2 3; on either side of main connecting rod 401 is secondary connecting rod 1 402 arranged on frame 1 and secondary connecting rod 2 403 arranged on crossbar 1 2; cross frame 4 is an X-shaped frame; when the chair is being used, main connecting rod 401, secondary connecting rod 1 402, and secondary connecting rod 2 403 ensure the strength of the connection between frame 1 and crossbar 1 2; additionally, the frame can deform depending on the deformation of frame 1 and crossbar 1 2.

Crossbar 1 2 comprises bar 1 201; the bottom of bar 1 201 is fitted with mount 1 202 accommodating main connecting rod 401; mount 1 202 internally accommodates mounting shaft 1 203 for connecting main connecting rod 401; crossbar 3 comprises bar 2 301; the top of bar 2 301 is fitted with mount 2 302 for installation of secondary connecting rod 1 402; mount 2 302 internally accommodates mounting shaft 3 303 for connecting main connecting rod 401; main connecting rod 401 is designed with through-hole 1 that fits with mounting shaft 1 203 and mounting shaft 3 303. By setting up mount 1 202 and mount 2 302, main connecting rod 401 can be rotatably arranged between bar 1 201 and bar 2 301, in coordination with mounting shaft 1 203, mounting shaft 3 303, and through-hole 1.

On one side of mount 1 202 is a mounting shaft 2 204 that is installed through bar 1 201; on one side of mount 2 302 is a mounting shaft 4 304 that is installed through bar 2 301; secondary connecting rod 1 402 and secondary connecting rod 2 403 are provided with through-holes designed to fit and cooperate with mounting shaft 2 204 and mounting shaft 4 304. By setting up mounting shaft 2 204 and mounting shaft 4 304, secondary connecting rod 1 402 and secondary connecting rod 2 403 can be rotatably arranged on both sides of bar 1 201 and bar 2 301, through coordination with through-hole 2.

The elastic support is spring 5 arranged between crossbar 1 2 and said crossbar 2 3, and the bottom end of spring 5 is securely attached to the top of crossbar 2 3. Spring 5, when subjected to compression or tension from crossbar 1 2, will support crossbar 1 2 to rebound under its own elasticity.

Located on the left side of cross frame 4, spring 5 is subjected to compression by the user sitting on the director's chair through crossbar 1 2 and crossbar 2 3; in response, spring 5 provides support.

Positioned on the right side of cross frame 4, spring 5 is stretched by the user sitting in the director's chair through crossbar 1 2 and crossbar 2 3. In response, spring 5 exerts its own elastic force to pull back crossbar 1 2 and crossbar 2 3.

The elastic support is curved elastic tube 6; one end of elastic tube 6 is connected to crossbar 3 3 while the other end of elastic tube 6 is connected to frame 1; elastic tube 6 passes through a channel opened in crossbar 1 2 and is connected to crossbar 2 movably. Incorporated elastic tube 6 provides support and rebound between frame 1 and crossbar 2 3 through its inherent elasticity.

In this particular embodiment, as depicted in FIGS. 1-6, the operational process of the cross-elastic director's chair presented is outlined as follows:

When sitting on frame 1 and leaning back, the user's body weight compresses the elastic support. As a result, the elastic support undergoes a buffered rebound due to its inherent elasticity. While frame 1 shakes, crossbar 4 deforms in response to the changes in distance between crossbar 1 2 and crossbar 2 3.

The aforementioned description is merely an additional embodiment of the present invention, and the scope of protection of the present invention is not limited thereto. Any skilled person in the field of this technology, within the scope disclosed in the present invention, can make equivalent substitutions or modifications based on the technical solution and concept of the present invention. All such substitutions or modifications are within the scope of protection of the present invention.

What is claimed is:

1. A cross-elastic director's chair comprising frame (1) and elastic base feet, which is characterized in that said elastic base feet comprise two sets of first crossbar (2), second crossbar (3), cross frame (4) and elastic support arranged at the bottom of said frame (1), said cross frame (4) is movably installed between said first crossbar (2) and said second crossbar (3);

said cross frame (4) comprises a main connecting rod (401) rotatably installed between each first crossbar (2) and each second crossbar (3);

said main connecting rod (401) is flanked by a first secondary connecting rod (402) and a second secondary connecting rod (403), which are pivotally mounted on said frame (1) and said first crossbar (2), respectively;

each first crossbar (2) comprises a first bar (201), a bottom of said first bar (201) is fitted with a first mount (202) accommodating said main connecting rod (401), an interior of said first mount (202) is furnished with first mounting shafts (203) used to connect said main connecting rod (401);

each second crossbar (3) comprises a second bar (301), a top of said second bar (301) is fitted with a second mount (302) accommodating said first secondary connecting rod (402);

an interior of said second mount (302) is furnished with a third mounting shaft (303) used to connect said main connecting rod (401).

2. The cross-elastic director' s chair according to claim 1, which is characterized in that said main connecting rod (401) is provided with first through-holes (7) that matches with said first mounting shafts (203) and said third mounting shaft (303).

3. The cross-elastic director's chair according to claim 2, which is characterized in that one side of said first mount (202) is provided with a second mounting shaft (204) installed through said first bar (201), and that one side of said second mount (302) is furnished with a fourth mounting shaft (304) installed through said second bar (301).

4. The cross-elastic director' s chair according to claim 3, which is characterized in that said first secondary connecting rod (402) and said second secondary connecting rod (403) are provided with second through-holes (8) matching with said second mounting shaft (204) and said fourth mounting shaft (304).

5. The cross-elastic director' s chair according to claim 1, which is characterized in that said elastic support is a spring (5) arranged between each first crossbar (2) and each second crossbar (3), and a bottom end of each spring (5) is securely attached to a top of each second crossbar (3).

6. The cross-elastic director' s chair according to claim 1, which is characterized in that said elastic support is curved elastic tube (6); one end of said elastic tube (6) is connected to said second crossbar (3) while the other end of said elastic tube (6) is connected to said frame (1).

* * * * *